US009820032B1

(12) United States Patent
Zhang et al.

(10) Patent No.: US 9,820,032 B1
(45) Date of Patent: Nov. 14, 2017

(54) SPEAKER SYSTEM FOR HIGH FIDELITY REPRODUCTION OF AUDIO SIGNALS

(71) Applicant: Unisinger LTD., Cupertino, CA (US)

(72) Inventors: Rong Zhang, Cupertino, CA (US); Charles Cyrus Vinai, New York, NY (US); Wei Liu, Dalian (CN)

(73) Assignee: Unisinger LTD., Cupertino, CA (US)

( * ) Notice: Subject to any disclaimer, the term of this patent is extended or adjusted under 35 U.S.C. 154(b) by 0 days.

(21) Appl. No.: 15/626,000

(22) Filed: Jun. 16, 2017

(51) Int. Cl.

| | |
|---|---|
| ***H04R 1/24*** | (2006.01) |
| ***H04R 3/14*** | (2006.01) |
| ***H04R 1/02*** | (2006.01) |
| ***H04R 1/28*** | (2006.01) |

(52) U.S. Cl.
CPC ..... *H04R 1/24* (2013.01); *H04R 1/025* (2013.01); *H04R 1/2826* (2013.01); *H04R 3/14* (2013.01)

(58) Field of Classification Search
CPC . H04R 1/24; H04R 1/025; H04R 3/14; H04R 1/2826
See application file for complete search history.

(56) References Cited

U.S. PATENT DOCUMENTS 4,930,596 A * 6/1990 Saiki ..... H04R 1/2865 181/152

* cited by examiner

*Primary Examiner* — Ping Lee
(74) *Attorney, Agent, or Firm* — Jingming Cai; SAC Attorneys LLP

(57) ABSTRACT

A speaker system for reproducing audio signals of multiple frequency ranges is provided. The speaker system includes a Venturi tube-shaped woofer chamber, a woofer driver, a tweeter unit, and a tweeter driver. The woofer driver and the tweeter driver reproduce low frequency audio signals and high frequency audio signals respectively. The Venturi tube-shaped woofer chamber produces a Venturi effect, offers low airflow resistance, and reproduces low frequency signals with high fidelity. An embodiment of the speaker system includes a subwoofer driver and a mid-woofer driver for reproducing extra low frequency audio signals, and medium frequency audio signals and low frequency audio signals respectively, in addition to the tweeter driver. The speaker system does not require a baffle installation. The woofer driver and the tweeter driver, and in an embodiment, the mid-woofer driver create a point sound source effect for offering a sense of immediacy to music enthusiasts and movie viewers.

30 Claims, 4 Drawing Sheets

SPEAKER SYSTEM FOR HIGH FIDELITY REPRODUCTION OF AUDIO SIGNALS

BACKGROUND

Loudspeakers form a major part of family audio and video entertainment systems. The loudspeakers, currently, fall into the following two categories: two-channel high fidelity (Hi-Fi) stereo speakers and multi-channel home theater speakers. Hi-Fi stereo speakers are used to listen to music. Most users of Hi-Fi stereo speakers are fans of music or audio equipment, and thus always emphasize on sound quality of music from Hi-Fi stereo speakers. While Hi-Fi stereo speakers output high fidelity music and a pleasant sound, most Hi-Fi stereo speakers partially lack a sense of immediacy and exhibit poor dynamic behavior at low frequency ranges of audio signals and thus provide an unsatisfactory experience while watching a movie. Multi-channel home theater speakers are used for watching movies. These multi-channel home theater speakers do not meet the demand of fans who prefer good sound quality when listening to music from the multi-channel home theater speakers and watching movies simultaneously.

At present, the multi-channel home theater speakers developed have 7.1 channels or more channels and a subwoofer driver that typically reproduces substantially low frequency band audio signals, and have attracted very few purchases because of the disorder created by installation of 8 or more speakers of the 7.1 or more channel home theater speakers in households. In general, users do not choose high fidelity (Hi-Fi) speakers for multi-channel home theater systems due to cost considerations. Often households that have installed the multi-channel home theater speakers discard the multi-channel home theater speakers after a short span of use since the multi-channel home theater speakers fail to offer Hi-Fi music to movie viewers. Thus, there is a need for a speaker system that reproduces audio signals of a wide range of frequencies with enhanced sound quality for watching movies and listening to music.

Most of the conventional loudspeakers comprise two or more speaker drivers that fit into an enclosure, for example, a cuboid shaped box in a vertical direction. A frequency divider in a conventional loudspeaker divides the audio signals to be reproduced by each of the speaker drivers based on frequencies of the audio signals. Such an enclosure forms a sound baffle for speaker drivers that may damage the tone and quality of the sound reproduced due to the limitation of the enclosure geometry and the material used to build the enclosure. Furthermore, sound quality degradation may be caused due to diffraction interferences among different sound frequencies on a baffle of a speaker driver and standing waves present in the enclosure. The non-uniformity of the material used to build the enclosure may also contribute the sound quality degradation. For example, a wooden material used to build the enclosure typically contains cracks and defects resulting in the sound quality degradation. Hence, there is a need for a speaker system that produces high quality audio sound of a wide range of frequencies without intrinsic sound degradation due to the interferences from possible standing waves in the enclosure and the frequency diffraction interferences from the baffle.

In general, a sound field from a conventional speaker system with a box enclosure typically forms a directional sound cone with a narrow solid angle along a central axis of the conventional speaker system. This narrow solid angle would squeeze a sweet spot in the middle of two or more speaker drivers of the conventional speaker system. A small lateral shift from the sweet spot shifts the whole auditory scene in the direction of the shift and for a listener off to the side, the scene collapses near one of the speaker drivers, and little is heard from the other speaker driver. Hence, there is a need for a speaker system that reproduces audio signals of wide range of frequencies without directivity.

In general, the sound signals in the middle frequency range to the high frequency range present more directivity due to their relatively short wavelength. Therefore, implementing a point sound source, that is, a speaker driver without a baffle, for the middle frequency range to the high frequency range requires a substantially small speaker driver to reduce its directivity. In general, if a speaker driver is placed in the middle of a space without any baffle, the sound wave produced by the speaker driver would be canceled out due to the opposite phases of the sound wave in the front and in the back of the speaker driver, thereby creating a sound wave short-circuit. On the other hand, a large speaker driver is normally required to reproduce the sound signals in the lower frequency range. Due to the longer wavelength at lower sound frequencies, large size of the large speaker driver will not result in directivity as in the mid sound frequency range to high sound frequency range. Hence, there is a need for a speaker system that produces a point sound source effect without using a baffle.

A majority of the sound speaker systems do not a adopt point sound source design. The PLUTO speaker system from Linkwitz Lab is an example of a floor-standing loudspeaker system to implement a point sound source speaker system. This loudspeaker system uses a forward-playing broadband speaker driver, a 2 inch full range driver, and an upward-playing woofer with a 5.25 inch diameter. The upward-playing woofer strengthens bass effect of the forward-playing broadband driver at low audio frequencies, which is installed on top of a vertically closed cylinder. A dynamic electronic frequency cross-over is configured and a four-channel audio frequency amplifier for such a loudspeaker system is implemented. The loudspeaker system creates a good point sound source characteristic with a substantially good sense of immediacy and dynamic behavior for the sound reproduction at multiple sound frequencies. The original designs of the Pluto series speaker systems from the Linkwitz Lab were provided to music lovers as do it yourself (DIY) projects with an unprecedented sound field effect. However, due to the limitation for the selection of the primary components from the design, the frequency response range was merely, for example, about 60 Hertz (Hz) to about 15000 Hz, which is less ideal for a requirement for a real high fidelity sound system. The Pluto speaker system utilizes electronic frequency division or preceding stage frequency division, with a set of specially designed power amplifiers to form an active speaker system. Such a speaker system is incompatible to connect with other external power amplifiers, and therefore the degree of freedom of selection of the external power amplifiers, a richer tone change, and listening experiences provided to the users are limited.

Hence, there is a need for a speaker system that reproduces audio signals of a wide range of frequencies and exhibits behavior of a point sound source without using a baffle. Moreover, there is a need for a speaker system comprising drivers molded on waist drum shaped enclosures using an alloy metal material to avoid interferences from the possible standing waves and resonance oscillations in the speaker system. Furthermore, there is a need for a speaker system that is compatible for connection to different external power amplifiers for usage flexibilities.

SUMMARY OF THE INVENTION

This summary is provided to introduce a selection of concepts in a simplified form that are further disclosed in the detailed description of the invention. This summary is not intended to determine the scope of the claimed subject matter.

The speaker system disclosed herein addresses the above recited need for reproducing audio signals of a wide range of frequencies and exhibiting behavior of a point acoustic source, where both speaker units, that is, a woofer unit and a tweeter unit, in the speaker system are mounted with no baffle to avoid any possible diffraction interferences caused on speaker baffles. Moreover, the speaker system disclosed herein comprises drivers molded on waist drum shaped enclosures using an alloy metal material to avoid interferences from the possible standing waves and resonance oscillations in the speaker system by taking advantage of the Venturi effect. Furthermore, the speaker system disclosed herein has calibers of the drivers in a specific ratio. Furthermore, the speaker system disclosed herein is compatible for connection to different external power amplifiers because a passive crossover is used.

The speaker system disclosed herein reproduces audio signals of multiple frequency ranges. The speaker system comprises a base member, a Venturi tube-shaped woofer chamber, a woofer driver, a tweeter unit, and a tweeter driver. The Venturi tube-shaped woofer chamber extends from an upper wall of the base member. The Venturi tube-shaped woofer chamber with a waist drum shape that takes advantage of the Venturi effect comprises an upper end, a middle section, and a lower end. The Venturi tube-shaped woofer chamber tapers from the upper end towards the middle section and expands from the middle section towards the lower end for producing a Venturi effect. Internal diameters of the upper end and the lower end of the Venturi tube-shaped woofer chamber are greater than an internal diameter of the middle section of the Venturi tube-shaped woofer chamber. The woofer driver is positioned at the upper end of the Venturi tube-shaped woofer chamber in an upward direction for reproducing low frequency audio signals. The tweeter unit is rigidly connected proximal to an upper end of the Venturi tube-shaped woofer chamber and extends outwardly from the upper end of the Venturi tube-shaped woofer chamber. The tweeter unit and the Venturi tube-shaped woofer chamber are acoustically independent. The tweeter unit is constituted by a semi-circular pipe section, a conical pipe section, and a tweeter driver at a distal end of the conical pipe section to form a point sound source. The tweeter driver is positioned at a distal end of the tweeter unit in a frontward direction for reproducing high frequency audio signals. In an embodiment, the tweeter driver reproduces audio signals of multiple frequency ranges. A horizontal central axis of the tweeter driver is perpendicular to a vertical central axis of the woofer driver. The woofer driver and the tweeter driver create a point sound source effect without a baffle. The sound waves of the woofer driver and the tweeter driver travel in a semispherical direction, thereby presenting characteristics of point sound sources, which form a realistic sound field in a full audio frequency region. The point sound source is formed in the tweeter unit along the horizontal central axis of the tweeter driver in reproducing audio signals received from an external audio component and thus creating a sense of immediacy for music enthusiasts.

An embodiment of the speaker system disclosed herein also reproduces audio signals of multiple frequency ranges. The speaker system comprises a base member, a partial S-shaped woofer chamber, a subwoofer driver, a mid-woofer driver, a tweeter unit, and a tweeter driver. In this embodiment, the partial S-shaped woofer chamber extends from an upper wall of the base member. The partial S-shaped woofer chamber comprises an upper end and a lower end. The partial S-shaped woofer chamber expands from the upper end towards the lower end for producing a Venturi effect. The internal diameter of the upper end of the partial S-shaped woofer chamber is smaller than an internal diameter of the lower end of the partial S-shaped woofer chamber. The subwoofer driver is positioned at the lower end of the partial S-shaped woofer chamber in a downward direction for reproducing extra low frequency audio signals. The mid-woofer driver is positioned at the upper end of the partial S-shaped woofer chamber in a frontward direction for reproducing medium frequency audio signals and low frequency audio signals. A horizontal central axis of the mid-woofer driver is perpendicular to a vertical central axis of the subwoofer driver. The tweeter unit is rigidly connected proximal to the upper end of the partial S-shaped woofer chamber and extends outwardly from the upper end of the partial S-shaped woofer chamber. The tweeter driver is positioned at a distal end of the tweeter unit in a frontward direction for reproducing high frequency audio signals. A horizontal central axis of the tweeter driver is parallel to the horizontal central axis of the mid-woofer driver. The tweeter driver and the mid-woofer driver create a point sound source effect without a baffle. The point sound sources are formed in both the tweeter driver and the mid-woofer driver along the horizontal central axis of the speaker drivers in reproducing audio signals received from an external audio component and thus creating a sense of immediacy for music enthusiasts. The speaker systems disclosed above perform high fidelity reproduction of audio signals.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific structures disclosed herein. The description of a structure referenced by a numeral in a drawing is applicable to the description of that structure shown by that same numeral in any subsequent drawings herein.

DETAILED DESCRIPTION OF THE INVENTION

Figure 1:
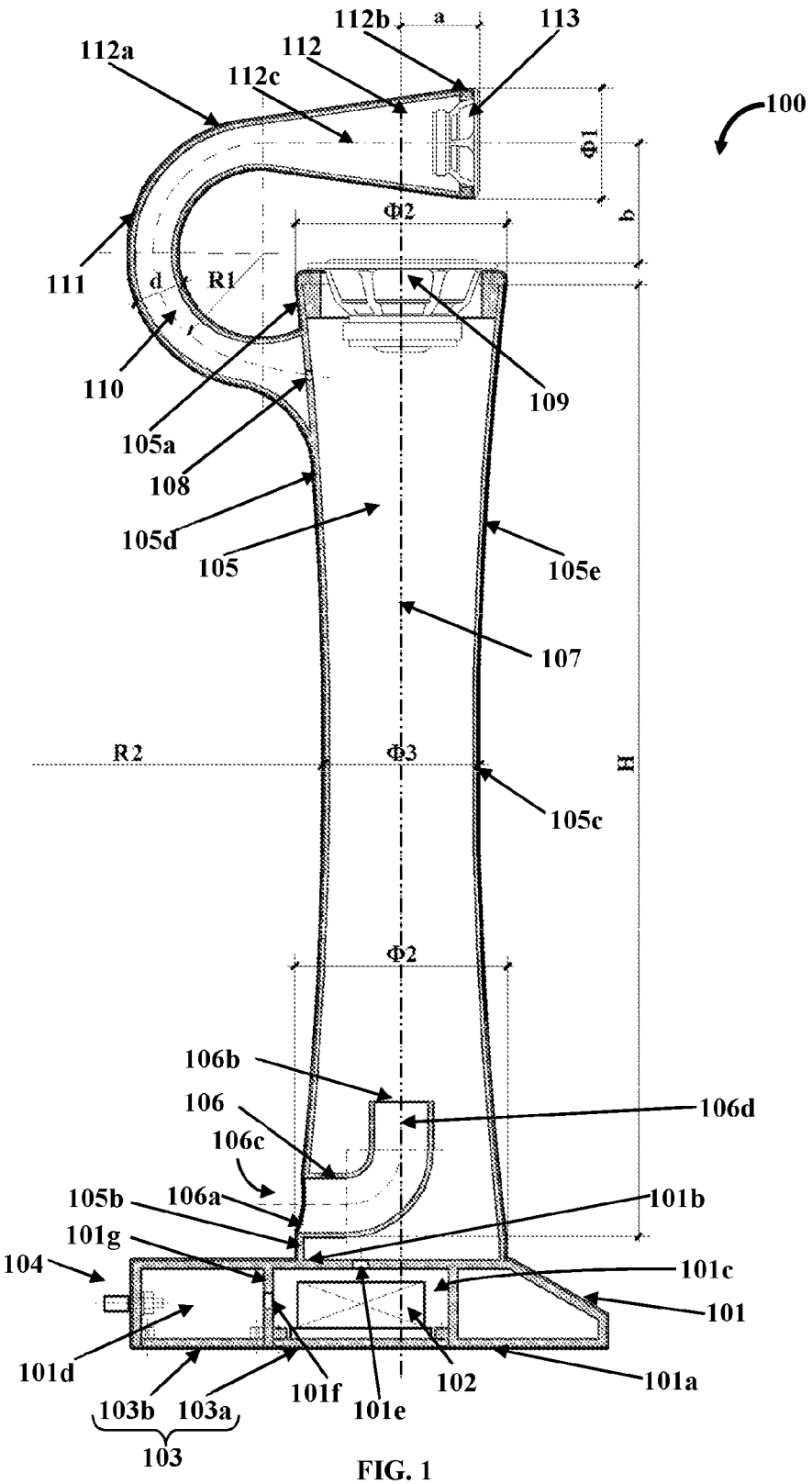
FIG. 1 exemplarily illustrates a sectional view of a speaker system.

FIG. 1 exemplarily illustrates a sectional view of a speaker system 100. A speaker system 100 is an electroacoustic transducer that converts an electric audio signal into sound that is audible to human ears. The electric audio signal is received from an external audio component, for example, a sound power amplifier, where an input of the external audio component is connected, for example, to a microphone, a television, a radio, a compact disc (CD) player, a phonograph player, etc. The electric audio signal is an electric signal representing voice inputs or sounds that vary with time. The electric audio signal is an analog signal or a digital signal. The analog signal is in the form of current, voltage, or charge changes in an electric circuit. The digital signal is constructed from a discrete set of waveforms of an electric signal to represent a sequence of discrete values as a sequence of symbols. The electric audio signals have frequencies in an audio frequency range. The audio frequency range is the range of frequencies of the audio signals audible to human ears. The audio frequency range spans from 20 hertz (Hz) to 20 kHz. The speaker system 100 converts the electric signals received from multiple sources into audio signals that are spread across the entire audio frequency range. Hereafter, electric audio signals are referred to as "audio signals".

As exemplarily illustrated in FIG. 1, the speaker system 100 comprises a base member 101, a Venturi tube-shaped woofer chamber 105, a woofer driver 109, a tweeter unit 110, and a tweeter driver 113. The base member 101 comprises a cavity 101*c* for accommodating a frequency divider 102, and a cavity 101*d* for accommodating at least one pair of binding posts 104. The base member 101 further comprises two connection holes 101*e* and 101*f* positioned on an upper wall 101*b* of the base member 101 and an intermediate wall 101*g* between the cavities 101*c* and 101*d* of the base member 101 respectively. The connection holes 101*e* and 101*f* allow connection wires (not shown) of the woofer driver 109 to connect to the frequency divider 102 accommodated in the base member 101. The diameters of the connection holes 101*e* and 101*f* are, for example, about 9 millimeters (mm) to about 15 mm. For example, in the speaker system 100 exemplarily illustrated in FIG. 1, the diameters of the connection holes 101*e* and 101*f* are about 12 mm. The dimensions and positions of the connection holes 101*e* and 101*f* are determined based on the design of the speaker system 100. At a lower end 101*a* of the base member 101, at least one cover plate 103 is positioned for protecting the frequency divider 102 accommodated in the base member 101. As exemplarily illustrated in FIG. 1, the speaker system 100 comprises two movable cover plates 103*a* and 103*b* positioned at the lower end 101*a* of the base member 101. The movable cover plate 103*a* protects the frequency divider 102 and the movable cover plate 103*b* protects the pair of binding posts 104. The binding posts 104 electrically connect the speaker system 100 to an external audio component. The frequency divider is a filter circuit that splits the received audio signals from an external audio component based on different frequencies. Speaker drivers, for example, the woofer driver 109, the tweeter driver 113, etc., in the speaker system 100 are designed for different frequency ranges. The frequency divider 102 feeds audio signals of different frequency ranges to corresponding speaker drivers. In an embodiment, the frequency divider 102 exemplarily illustrated in FIG. 1, acts as a bass frequency crossover for processing frequencies associated with the woofer driver 109. The bass frequency crossover splits an amplified audio signal coming from an external power amplifier so that the amplified audio signal can be sent to two or more speaker drivers, for example, the woofer driver 109 and the tweeter driver 113.

The Venturi tube-shaped woofer chamber 105 extends from an upper wall 101*b* of the base member 101. As exemplarily illustrated in FIG. 1, the Venturi tube-shaped woofer chamber 105 is a waist drum shaped quasi-cylindrical tube with opposing surfaces 105*d* and 105*e*. The Venturi tube-shaped woofer chamber 105 comprises an upper end 105*a*, a middle section 105*c*, and a lower end 105*b*. The lower end 105*b* of the Venturi tube-shaped woofer chamber 105 is connected to the upper wall 101*b* of the base member 101, and the upper end 105*a* of the Venturi tube-shaped woofer chamber 105 is open. The Venturi tube-shaped woofer chamber 105 tapers from the upper end 105*a* towards the middle section 105*c* and then expands from the middle section 105*c* towards the lower end 105*b* for producing a Venturi effect. The Venturi effect is a reduction in sound pressure that results when sound flows through the constricted middle section 105*c* of the Venturi tube-shaped woofer chamber 105. The Venturi tube-shaped woofer chamber 105 has a circular cross section. The upper end 105*a* of the Venturi tube-shaped woofer chamber 105 is symmetrical to the lower end 105*b* of the Venturi tube-shaped woofer chamber 105 as exemplarily illustrated in FIG. 1.

As exemplarily illustrated in FIG. 1, the internal diameters (Φ2) of the upper end 105*a* and the lower end 105*b* of the Venturi tube-shaped woofer chamber 105 are symmetrical, that is, ($\Phi 2_{upper}=\Phi 2_{lower}$). In an embodiment (not shown), the internal diameters (Φ2) of the upper end 105*a* and the lower end 105*b* of the Venturi tube-shaped woofer chamber 105 are unsymmetrical, that is, ($\Phi 2_{upper}\neq\Phi 2_{lower}$). Internal diameters (Φ2) of the upper end 105*a* and the lower end 105*b* of the Venturi tube-shaped woofer chamber 105 are greater than an internal diameter (Φ3) of the middle section 105*a* of the Venturi tube-shaped woofer chamber 105, that is, (Φ2>Φ3). The ratio of the internal diameter of the upper end 105*a* of the Venturi tube-shaped woofer chamber 105 to the internal diameter of the middle section 105*c* of the Venturi tube-shaped woofer chamber 105 is predetermined, normally in the range of 1.3 to 2.0. Similarly, the ratio of the internal diameter of the lower end 105*b* of the Venturi tube-shaped woofer chamber 105 to the internal diameter of the middle section 105*c* of the Venturi tube-shaped woofer chamber 105 is predetermined, normally in the range of 1.3 to 2.3. In the speaker system 100 exemplarily illustrated in FIG. 1, the internal diameters of the upper end 105*a* and the lower end 105*b* of the Venturi tube-shaped woofer chamber 105 are, for example, 1.36 times of the internal diameter of the middle section 105*c* of the Venturi tube-shaped woofer chamber 105.

The Venturi tube-shaped woofer chamber 105 offers a Venturi tube effect to the received audio signals. The Venturi tube effect enhances the quality of the ultralow frequency quantity perception, low frequency depth capacity, and reaction speed. The Venturi tube-shaped woofer chamber 105 reduces interferences caused by possible standing waves in the Venturi tube-shaped woofer chamber 105 and possible resonance oscillations in the Venturi tube-shaped woofer chamber 105. The Venturi tube-shaped woofer chamber 105 also maintains a distinctive nuance of low frequency under a large, dynamic and high sound pressure. The Venturi tube-shaped woofer chamber 105 with a small airflow resistance and high flow rate is substantially conducive to diving of the low frequency and bursts of sound energy, thus creating enhanced low frequency effects. The Venturi tube-shaped woofer chamber 105 provides an aesthetic appeal to the speaker system 100. Wind instruments used by a symphony orchestra comprising, for example, a clarinet, a resonating tube of a trombone, increase the speed of the airflow down the respective tubes, thereby enabling a better tone, response, intonation, etc., due to the Venturi effect in the respective tubes.

The Venturi tube-shaped woofer chamber 105 is a ported type woofer chamber or a closed or sealed type woofer chamber. As used herein, "ported type woofer chamber" is a Venturi tube-shaped woofer chamber 105 with a port or a vent cut proximal to the lower end 105*b* of one of the opposing surfaces 105*d* and 105*e*, wherein a phase-reversing tube 106 is affixed to the port. Also, as used herein, "closed type woofer chamber" is a Venturi tube-shaped woofer chamber 105 with no vents and that is completely sealed by the opposing surfaces 105*d* and 105*e*, the base member 101, and the woofer driver 109. The Venturi tube-shaped woofer chamber 105 exemplarily illustrated in FIG. 1, is a ported type woofer chamber with the phase-reversing tube 106. The upper end 105*a* and the lower end 105*b* of the Venturi tube-shaped woofer chamber 105 has a diameter Φ2=190 mm. The middle section 105*a* of the Venturi tube-shaped woofer chamber 105 has an internal diameter Φ3=140 mm and an external radius R2=3797 mm forming the drum waist of the Venturi tube-shaped woofer chamber 105. The height of the Venturi tube-shaped woofer chamber 105 is H=868 mm.

The speaker system 100 further comprises a phase-reversing tube 106 configured as a bass reflex unit. The phase-reversing tube 106 extends into the Venturi tube-shaped woofer chamber 105 for enhancing low frequency audio signals reproduced by the woofer driver 109. The phase-reversing tube 106 in a general bass reflex loudspeaker system strengthens the lower frequency audio signals. A zoom-type conduit is adopted in the phase-reversing tube 106 to produce an effect similar to the Venturi effect. In an embodiment as exemplarily illustrated in FIG. 1, the bass reflex unit 106 is defined by a 90° elbow pipe comprising a first end 106*a* rigidly connected proximal to the upper wall 101*b* of the base member 101 with a vent 106*c* external to the Venturi tube-shaped woofer chamber 105 and a free second end 106*b* extending into the Venturi tube-shaped woofer 105 chamber parallel to a vertical central axis 107 of the Venturi tube-shaped woofer chamber 105. The first end 106*a* of the phase-reversing tube 106 is positioned in a direction opposite to the tweeter driver 113 as exemplarily illustrated in FIG. 1. In the speaker system 100 exemplarily illustrated in FIG. 1, the phase-reversing tube 106 is a 90° elbow pipe with the first end 106*a* rigidly connected proximal to the upper wall 101*b* of the base member 101. The phase-reversing tube 106 is connected perpendicular to the opposing surface 105*d* of the Venturi tube-shaped woofer chamber 105 with its vent 106*c* open to the outside of the Venturi tube-shaped woofer chamber 105. The open direction of the phase-reversing tube 106 is opposite to the tweeter driver 113. The phase-reversing tube 106 comprises a circular cross-section symmetrical about an axis 106*d* of the phase-reversing tube 106. The phase-reversing tube 106 enhances the bass output of the woofer driver 109.

The woofer driver 109 is positioned at the upper end 105*a* of the Venturi tube-shaped woofer chamber 105 in an upward direction for reproducing low frequency audio signals. The woofer driver 109 is a speaker driver with a large caliber. As used herein, "caliber" refers to an encircle diameter, that is, an internal diameter of a circular element. The caliber of the woofer driver 109 is, for example, between about 5.5 inches to about 13 inches. For example, the woofer driver 109 exemplarily illustrated in FIG. 1, has a caliber of 6.5 inches. The tweeter unit 110 is rigidly connected proximal to the upper end 105*a* of the Venturi tube-shaped woofer chamber 105 and extends outwardly from the upper end 105*a* of the Venturi tube-shaped woofer chamber 105. The tweeter unit 110 is connected proximal to the upper end 105*a* of the Venturi tube-shaped woofer chamber 105 via a connection hole 108. In the speaker system 100 exemplarily illustrated in FIG. 1, the tweeter unit 110 is rigidly connected to the opposing surface 105*d* proximal to the upper end 105*a* of the Venturi tube-shaped woofer chamber 105 via the connection hole 108. The connection hole 108 allows connection wires (not shown) of the tweeter driver 113 to connect to the frequency divider 102 accommodated in the base member 101. The connection hole 108 is positioned at the center of a connecting interface between the tweeter unit 110 and the left side opposing surface 105*d* of the Venturi tube-shaped woofer chamber 105 to accommodate connecting wires between the tweeter driver 113 and the frequency divider 102. The diameter of the connection hole 108 is, for example, about 9 millimeters (mm) to about 15 mm. For example, in the speaker system 100 exemplarily illustrated in FIG. 1, the diameter of the connection hole 108 is about 12 mm. The dimension and position of the connection hole 108 are determined based on the design of the speaker system 100. The connection hole 108 does not affect a sound isolation between the Venturi tube-shaped woofer chamber 105 and the tweeter unit 110.

The tweeter unit 110 is filled with an acoustic damping material. The acoustic damping material, for example, a wool felt, a rubber, a sponge, a chemical fiber porous cotton, etc., absorbs energy of low frequency audio signals reproduced by the tweeter unit 110 based on damping characteristics of the acoustic damping material. Furthermore the acoustic damping materials can make the sound energy in the tweeter unit 110 attenuate rapidly while facilitating interfacing with sound production. In this embodiment, the acoustic damping material is made of a macromolecule resin fiber, for example, a superabsorbent polymer or a slush powder. In an embodiment as exemplarily illustrated in FIG. 1, a semi-circular pipe section 111 and a conical pipe section 112 extending from the semi-circular pipe section 111 constitute the tweeter unit 110. The tweeter driver 113 is positioned at a distal end 112*b* of the conical pipe section 112 of the tweeter unit 110. In the tweeter unit 110 illustrated in FIG. 1, ratio of a diameter of the distal end 112*b* and a proximal end 112*a* of the conical pipe section 112 is predetermined, for example, 2.17:1, and ratio of an axis bending radius of the semi-circular pipe section 111 and an external diameter of the semi-circular pipe section 111 is predetermined, for example, 2.22:1. In FIG. 1, the distal end 112*b* of a conical pipe section 112 of the tweeter unit 110 has a diameter Φ1=98 millimeter (mm). The semi-circular pipe section 111 of the tweeter unit 110 has a bending radius R1=100 mm and an external diameter d=45 mm. The tweeter driver 113 in the conical pipe section 112 of the tweeter unit 110 is positioned above the woofer driver 109 of the Venturi tube-shaped woofer chamber 105. The tweeter driver 113 is positioned at a distal end of the tweeter unit 110 in a frontward direction for reproducing high frequency audio signals. The tweeter driver 113 reproduces the high frequency audio signals or full frequency range audio signals, that is, about 100 Hz to about 20 kHz from the external audio component. The frequency range of the audio signals, that is, whether the tweeter driver 113 is responsible for the full range audio signals or only the high frequency range signals is determined based on the design of the speaker system 100. In an embodiment where the frequency divider 102 is used, the crossover frequency is selected between, for example, about 500 Hz to about 4500 Hz depending on the specific tweeter driver 113 selected. Caliber of the tweeter driver 113 is, for example, between about 3 inches to about 4.5 inches. For example, the tweeter driver 113 exemplarily illustrated in FIG. 1, has a caliber of 4 inches.

As exemplarily illustrated in FIG. 1, a horizontal central axis of the tweeter driver 113 is perpendicular to a vertical central axis of the woofer driver 109. A horizontal distance between the vertical central axis 107 of the woofer driver 109 and the tweeter driver 113, indicated by "a", is, for example, about 50 millimeters (mm) to about 160 mm. A vertical distance between the woofer driver 109 and a horizontal central axis 112*c* of the tweeter driver 113, indicated by "b", is, for example, about 70 mm to about 500 mm. The tweeter unit 110 is structurally mutually independent of the Venturi tube-shaped woofer chamber 105, that is, air does not flow between the Venturi tube-shaped woofer chamber 105 and the tweeter unit 110. To improve the sound quality of a speaker system, the sizes of a mounting baffle of speaker drivers, for example, the woofer driver 109 and the tweeter driver 113 should be as small as possible to avoid diffraction interferences. The woofer driver 109 and the tweeter driver 113 of the speaker system 100 disclosed herein create a point sound source effect without a baffle. The speaker system 100 with no baffle brings further improves the sound quality. The point sound source is formed in the tweeter unit 110 along a horizontal central axis 112*c* of the tweeter driver 113 in reproducing audio signals received from the external audio component and thus creating a sense of immediacy for music enthusiasts.

The base member 101, the Venturi tube-shaped woofer chamber 105, and the tweeter unit 110 are molded or welded with metal alloys, for example, aluminum alloys. The speaker system 100 molded with metal alloys avoids interference noise caused by the resonance oscillations in the speaker system 100, and permits the speaker system 100 to create a clear sound with rich details and a distinctive nuance. In an embodiment, the base member 101, the Venturi tube-shaped woofer chamber 105, and the tweeter unit 110 are molded with timber. The woofer driver 109 and the tweeter driver 113 are made of same vibration tub materials, for example, papers, silk fabrics, chemical fibers, thin film of metal alloys, and synthetic materials. As used herein, "vibration tub" refers to a working terminal of a speaker driver, for example, the woofer driver 109 or the tweeter driver 113. The speaker driver transforms electric energy into sound energy and makes a sound via vibrations of the vibration tub. The vibration tub materials determine tone and quality of sound produced by the speaker driver. The application of the same kind of vibration tub materials to the woofer driver 109 and the tweeter driver 113 improves the smoothness of a frequency response transition and makes the sound more natural. In an embodiment, the vibration tub is made up of a polypropylene fiber woven material. The polypropylene fiber woven material, by which, the sound produced by the tweeter driver 113 and the woofer driver 109 in the full audio frequency range is substantially smooth and natural, thereby providing an impression that the sound comes out of only one speaker driver. The woofer driver 109 diffuses and radiates the reproduced low frequency audio signals vertically upwards in a semisphere. The semisphere diffusion of the reproduced low frequency audio signals enhances the depth and width of sound field for a better sound stage experience. The speaker system 100 is suitable to be employed in a household with a few restrictions on acoustics, as well as in an elaborately designed audio room.

The binding posts 104 accommodated in the cavity 101*d* of the base member 101 of the speaker system 100 exemplarily illustrated in FIG. 1, connect the woofer driver 109 and the tweeter driver 113 internally through the frequency divider 102. The binding posts 104 externally connect the woofer driver 109 and the tweeter driver 113 to one or more external audio components, for example, one or more power amplifiers. For example, the binding posts 104 connect the woofer driver 109 and the tweeter driver 113 to one external power amplifier provided for each of the binding posts 104 or one external power amplifier provided for the pair of binding posts 104. The frequency divider 102 is electrically connected to the woofer driver 109 and the tweeter driver 113 for splitting the audio signals received from the external audio component, while feeding the crossover audio signals to the woofer driver 109 and the tweeter driver 113. The speaker system 100 exemplarily illustrated in FIG. 1, has a crossover frequency of, for example, about 500 hertz (Hz). That is, the frequency divider 102 splits the received audio signals at the crossover frequency of 500 Hz. The frequency divider 102 feeds received audio signals with frequencies, for example, between about 30 Hz to about 500 Hz to the woofer driver 109 and the received audio signals with frequencies, for example, between about 100 Hz to about 20 kHz to the tweeter driver 113. That is, the tweeter driver 113 operates without a frequency division in the entire range of 100 Hz to 20 kHz frequencies of the received audio signals. The frequency range 100 Hz to 500 Hz of the received audio signals reproduced simultaneously by the tweeter driver 113 is limited and damped by the acoustic damping material in the structure of the tweeter unit 110. Suitable quality and quantity of the acoustic damping material is determined through tests. On using a suitable acoustic damping material, there is no bulge or sag in the overlapping frequency range between the tweeter unit 110 and the woofer driver 109 in the measured frequency response curve across a full audio frequency range of the speaker system 100. Since there is no frequency division for tweeter driver 113, and the vibration tub material used for the tweeter driver 113 is the same as the vibration tub material, for example, polypropylene fiber woven tub, of the woofer driver 109, the speaker system 100 generates a sound smoothly and the degree of tone fusion generated by the woofer driver 109 and the tweeter driver 113 is about 100%. In this way, the audio signals reproduced by the woofer driver 109 and the tweeter driver 113 sounds identical which cannot be distinguished.

The speaker system 100 comprises a tweeter driver 113 with a caliber of, for example, about 3 inches to about 6 inches, and a woofer driver 109 with a caliber of, for example, about 5 inches to about 12 inches. In an embodiment, the speaker system 100 comprises a tweeter driver 113 with a caliber of, for example, about 3 inches, and a woofer driver 109 with a caliber of, for example, about 5.5 inches. In another embodiment, the speaker system 100 comprises a tweeter driver 113 with a caliber of, for example, about 3.5 inches, and a woofer driver 109 with a caliber of, for example, about 6 inches or 5.5 inches or 6.5 inches. In another embodiment, the speaker system 100 comprises a tweeter driver 113 with a caliber of, for example, about 4 inches, and a woofer driver 109 with a caliber of, for example, about 6.5 inches or 5.5 inches or 6 inches or 7 inches or 8 inches. In another embodiment, the speaker system 100 comprises a tweeter driver 113 with a caliber of, for example, 5 inches, and a woofer driver 109 with a caliber of, for example, about 8 inches. In another embodiment, the speaker system 100 comprises a tweeter driver 113 with a caliber of, for example, 6 inches, and a woofer driver 109 with a caliber of, for example, about 10 inches or 12 inches. The woofer driver 109 reproduces received audio signals of a frequency range of, for example, about 20 Hz to about 1000 Hz. The frequency range of operation of the woofer driver 109 is selected based on a specific combination of the woofer driver 109 and the tweeter driver 113. Based on relative positions of the tweeter driver 113 and the woofer driver 109 in the speaker system 100, indicated by a and b, sizes of the tweeter driver 113 and the woofer driver 109 are related to the calibers of the tweeter driver 113 and the woofer driver 109. The calibers of the tweeter driver 113 and the woofer driver 109 are responsible for the behavior of the speaker system 100 as a point sound source and also create an improved sound field and a sense of immediacy.

The speaker system 100 disclosed herein requires no baffle installation. Since the speaker system 100 has been molded with metal alloys, based on a space layout of an area of installation of the speaker system 100 and relative positions of the woofer driver 109 and the tweeter driver 113, a point sound source is created in the speaker system 100. To make the woofer driver 109 and the tweeter driver 113 as a point sound source, the woofer driver 109 and the tweeter driver 113 are mounted in the Venturi tube-shaped woofer chamber 105 and the tweeter unit 110 respectively, without any baffle. The sound radiation from the point sound source is emitted into a semisphere in front of the woofer driver 109 and the tweeter driver 113 so that two of such point sound sources with stereo sound waves result in a spacious sound field instead of a very narrow sweet spot as most of the conventional speaker systems. Furthermore, sound waves produced by the woofer driver 109 and the tweeter driver 113 travel in a semispherical direction, thereby presenting characteristics of point sound sources and forming a realistic sound field in the full audio frequency range. The speaker system 100 produces a strong sense of immediacy by minimizing effect of environmental acoustic condition on hearing the reproduced audio signals. The speaker system 100 is designed to be used, for example, in living rooms of households.

Figure 2:
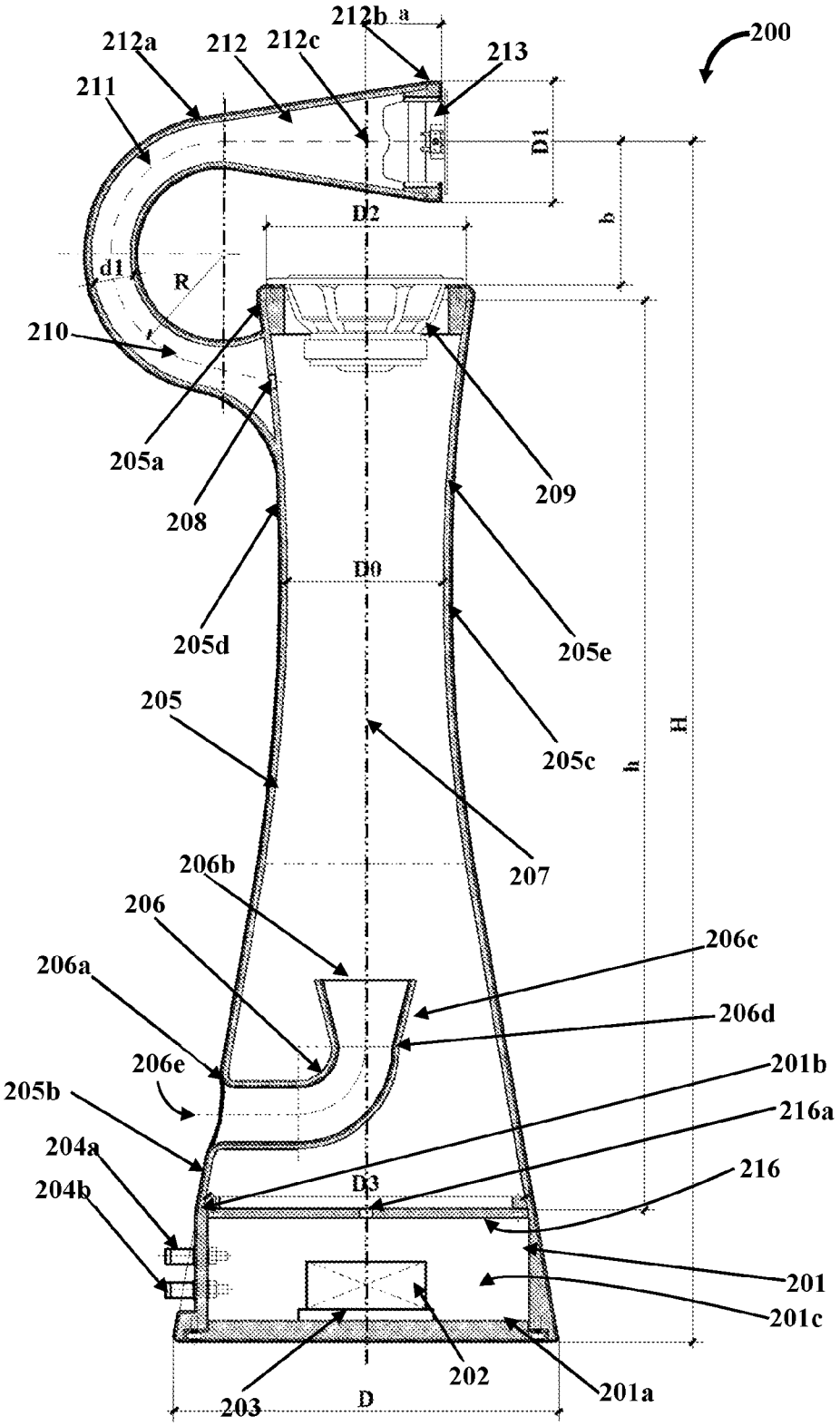
FIG. 2 exemplarily illustrates a sectional view of an embodiment of the speaker system.

FIG. 2 exemplarily illustrates a sectional view of an embodiment of the speaker system 100 exemplarily illustrated in FIG. 1. The speaker system 200 exemplarily illustrated in FIG. 2, is a modification of the speaker system 100 exemplarily illustrated in FIG. 1. In this embodiment, the speaker system 200 exemplarily illustrated in FIG. 2, comprises a base member 201, a Venturi tube-shaped woofer chamber 205, a woofer driver 209, a tweeter unit 210, and a tweeter driver 213. The base member 201 comprises a cavity 201*c* for accommodating a frequency divider 202 as disclosed in the detailed description of FIG. 1. The base member 201 is integrated with the Venturi tube-shaped woofer chamber 205 and the frequency divider 202 is installed into the base member 201 of the Venturi tube-shaped woofer chamber 205 to increase the aesthetic appeal of the speaker system 200. The design of the speaker system 200 provides increased aesthetic appeal that is more suitable to the surrounding furniture in a living room, while maintaining the acoustic characteristics of the speaker system 200. A movable cover plate 203 is positioned on a lower end 201*a* of the base member 201 for protecting the frequency divider 202. In an embodiment, the frequency divider 202 exemplarily illustrated in FIG. 2, implements frequency division for both the woofer driver 209 and the tweeter driver 213 simultaneously, that is, the frequency divider 202 acts as a crossover frequency divider for the speaker system 200. The frequency divider 202 splits audio signals received from the external audio component based on frequency of the received audio signals between the woofer driver 209 and the tweeter driver 213. In an embodiment, the frequency division point is 500 Hz. The frequency range of the woofer driver 209 is, for example, about 30 Hz to about 500 Hz, and the frequency range of the tweeter driver 213 is, for example, about 100 Hz to about 20 kHz. As exemplarily illustrated in FIG. 2, two sets of binding posts 204*a* and 204*b* extend from the base member 201. The binding post 204*a* connects the tweeter driver 213 of the tweeter unit 210 while the binding post 204*b* connects the woofer driver 209 of the Venturi tube-shaped woofer chamber 205 internally through the frequency divider 202. The binding posts 204*a* and 204*b* are externally connected to external audio components, for example, through one or two amplifiers (not shown). The woofer driver 209 and the tweeter driver 213 are installed without a baffle, which produce sounds in a manner of point source, realizing a high level fidelity of reproduction of music as well as developing a sense of immediacy as disclosed in the detailed description of FIG. 1.

In an embodiment, the binding posts 204*a* and 204*b* are connected in parallel using a single external audio component, for example, a power amplifier, to drive both speaker drivers, that is, the woofer driver 209 and the tweeter driver 213 as disclosed in the detailed description of FIG. 1. In this embodiment, the external audio component is connected to the binding posts 204*a* and 204*b* via a single external power amplifier. The binding posts 204*a* and 204*b* are connected in parallel using two bridging copper sheets. That is, the woofer driver 209 and the tweeter driver 213 are fed using a single cable from an external power amplifier via a bi-wiring arrangement to the binding posts 204*a* and 204*b*. The speaker system 100 disclosed herein is compatible for connection to different external power amplifiers because a passive crossover is used. The passive crossover splits an amplified audio signal coming from an external power amplifier so that the amplified audio signal can be sent to two or more speaker drivers, for example, the woofer driver 209 and the tweeter driver 213.

In another embodiment, the external audio components are connected via two external power amplifiers to the two binding posts 204*a* and 204*b* respectively. The woofer driver 209 and the tweeter driver 213 are bi-wired to the two external power amplifiers. That is, the signals for the woofer driver 209 are fed separately via a cable from a first external power amplifier and the signals for the tweeter driver 213 are fed separately via a cable from a second external power amplifier. That is, volume level of the woofer driver 209 and the tweeter driver 213 can be adjusted to remedy unbalanced volume sense resulted from unsatisfactory acoustic surroundings, while expanding the sound field and dynamic effect. On connecting the woofer driver 209 and the tweeter driver 213 separately to the binding posts 204*a* and 204*b*, the woofer driver 209 becomes an independent speaker and the tweeter driver 213 becomes an independent speaker. In this embodiment, the two power amplifiers connected to the binding posts 204*a* and 204*b* obtain electric signals in parallel with a single signal source, for example, a compact disc (CD) player, a digital versatile disc (DVD) player, a radio, a microphone, or a phonograph player.

In an embodiment, a space divider plate 216 is positioned proximal to the upper end 201*b* of the base member 201 for adjusting volume of space within the Venturi tube-shaped woofer chamber 205 based on the woofer driver 209 implemented in the Venturi tube-shaped woofer chamber 205 as exemplarily illustrated in FIG. 2. The space divider plate 216 adjusts the volume of the spaces in the Venturi tube-shaped woofer chamber 205 to accommodate different space volumes required by different woofer drivers 209 that may be chosen. This removable space divider plate 216 is mounted below the phase-reversing tube 205 and fastened onto the opposing surfaces 205*d* and 205*e* of the Venturi tube-shaped woofer chamber 205 at the end 201*b* using fasteners, for example, screws (not shown). By removing the bottom cover plate 203 and the frequency divider 202, the space divider plate 216 can be removed. When the space divider plate 216 is removed, the volume of the Venturi tube-shaped woofer chamber 205 increases, for example, by 30%. The space divider plate 216 comprises a connection hole 216*a* for accommodating connecting wires that connect the woofer driver 209 and the tweeter driver 213 to the frequency divider 202. The diameter of the connection hole 216*a* is, for example, between about 9 millimeters (mm) to about 15 mm. For example, in the speaker system 200 exemplarily illustrated in FIG. 2, the diameter of the connection hole 216*a* is about 12 mm.

The Venturi tube-shaped woofer chamber 205 is a converging-diverging tube shaped vibration chamber that accommodates the woofer driver 209 and the phase-reversing tube 206. The Venturi tube-shaped woofer chamber 205 extends from an upper end 201*b* of the base member 201 and accommodates the phase-reversing tube 206 and the woofer driver 209 as disclosed in the detailed description of FIG. 1. Caliber of the woofer driver 209 is, for example, about 6.5 inches. The Venturi tube-shaped woofer chamber 205 expands from the upper end 205*a* towards the base member 201. The Venturi effect in the Venturi tube-shaped woofer chamber 205 has a fast response and a better low frequency reproduction effect, satisfying the requirements of music and movie enthusiasts. In an embodiment, the upper end 105*a* of the Venturi tube-shaped woofer chamber 105 is unsymmetrical to the lower end 105*b* of the Venturi tube-shaped woofer chamber 105. As exemplarily illustrated in FIG. 2, the internal diameter (D2) of the upper end 205*a* of the Venturi tube-shaped woofer chamber 205 is unsymmetrical to the internal diameter (D3) of the lower end 205*b* of the Venturi tube-shaped woofer chamber 205, that is, (D2≠D3). In FIG. 2, the lower end 201*a* of the base member 201 has a diameter D=338 millimeter (mm), the Venturi tube-shaped woofer chamber 205 has a diameter D0=140 mm, the distal end 212*b* of a conical pipe section 212 has a diameter D1=104 mm, the woofer driver 209 has a diameter D2=180 mm, the upper end 201*b* of the bases member 201 has a diameter D3=286 mm, the semi-circular pipe section 211 of the tweeter unit 210 has a bending radius R=100 mm and an internal diameter d1=35 mm, the Venturi tube-shaped woofer chamber 205 has a height h=800 mm, and the distance between the lower end 201*a* and the horizontal axis of the tweeter driver 213 is H=1050 mm.

The phase-reversing tube 206 is defined by a 90° elbow pipe that extends into the Venturi tube-shaped woofer chamber 205. The phase-reversing tube 206 comprises a first end 206*a* rigidly connected proximal to an upper end 201*b* of the base member 201 with a vent 206*e* external to the Venturi tube-shaped woofer chamber 205, and a free second end 206*b* parallel to a vertical central axis 207 of the Venturi tube-shaped woofer chamber 205 and extending into the Venturi tube-shaped woofer chamber 205. The first end 206*a* of the phase-reversing tube 206 is positioned in a direction opposite to the tweeter driver 213. In an embodiment as exemplarily illustrated in FIG. 2, an upper section 206*c* of the phase-reversing tube 206 is configured in a conical shape comprising an upper end, that is, the free second end 206*b* and a lower end 206*d* for reducing airflow resistance and enhancing a low frequency response of the phase-reversing tube 206 with high speed and high intensity, thereby acquiring better low frequency dynamic effect. An internal diameter of the free second end 206*b* of the phase-reversing tube 206 is greater than an internal diameter of the lower end 206*d* of the upper section 206*c* of the phase-reversing tube 206.

The tweeter unit 210 is rigidly connected to one of the opposing surfaces, for example, a left side opposing surface 205*d*, proximal to an upper end 205*a* of the Venturi tube-shaped woofer chamber 205 via a connection hole 208. The connection hole 208 is positioned at the center of a connecting interface between the tweeter unit 210 and the left side opposing surface 205*d* of the Venturi tube-shaped woofer chamber 205 for accommodating connecting wires between the tweeter driver 213 and the frequency divider 202. The diameter of the connection hole 208 is, for example, between about 9 millimeters (mm) to about 15 mm. For example, in the speaker system 200 exemplarily illustrated in FIG. 2, the diameter of the connection hole 208 is about 12 mm. The connection hole 208 will not affect the sound isolation between the Venturi tube-shaped woofer chamber 205 and the tweeter unit 210. The tweeter unit 210 is constituted by a semi-circular pipe section 211 and a conical pipe section 212 extending from the semicircular pipe section 211 as disclosed in the detailed description of FIG. 1. The tweeter driver 213 is positioned at a distal end 212*b* of the conical pipe section 212. In this embodiment, the tweeter driver 213 in the conical pipe section 212 of the tweeter unit 210 is positioned above the woofer driver 209 of the Venturi tube-shaped woofer chamber 205. A horizontal distance between a vertical central axis 207 of the woofer driver 209 and the tweeter driver 213, indicated by "a" in FIG. 2, is, for example, about 66 mm, and a vertical distance between the woofer driver 209 and a horizontal central axis 212*c* of the tweeter driver 213, indicated by "b" in FIG. 2, is, for example, about 110 mm. In an embodiment, the tweeter driver 213 with a smaller caliber installed on one end of an upper bend will be no longer limited to full frequency speaker drivers, but extended to be applied by both full frequency speaker driver and a high-frequency range tweeter driver. At the same time, the frequency range required to set up a proper crossover frequency expands, for example, from about 500 Hz to about 4500 Hz for a 2-channel speaker system. Hence, different speaker driver combinations can be installed in one speaker system 200, enabling music enthusiasts to experience more abundant tones.

Figure 3:
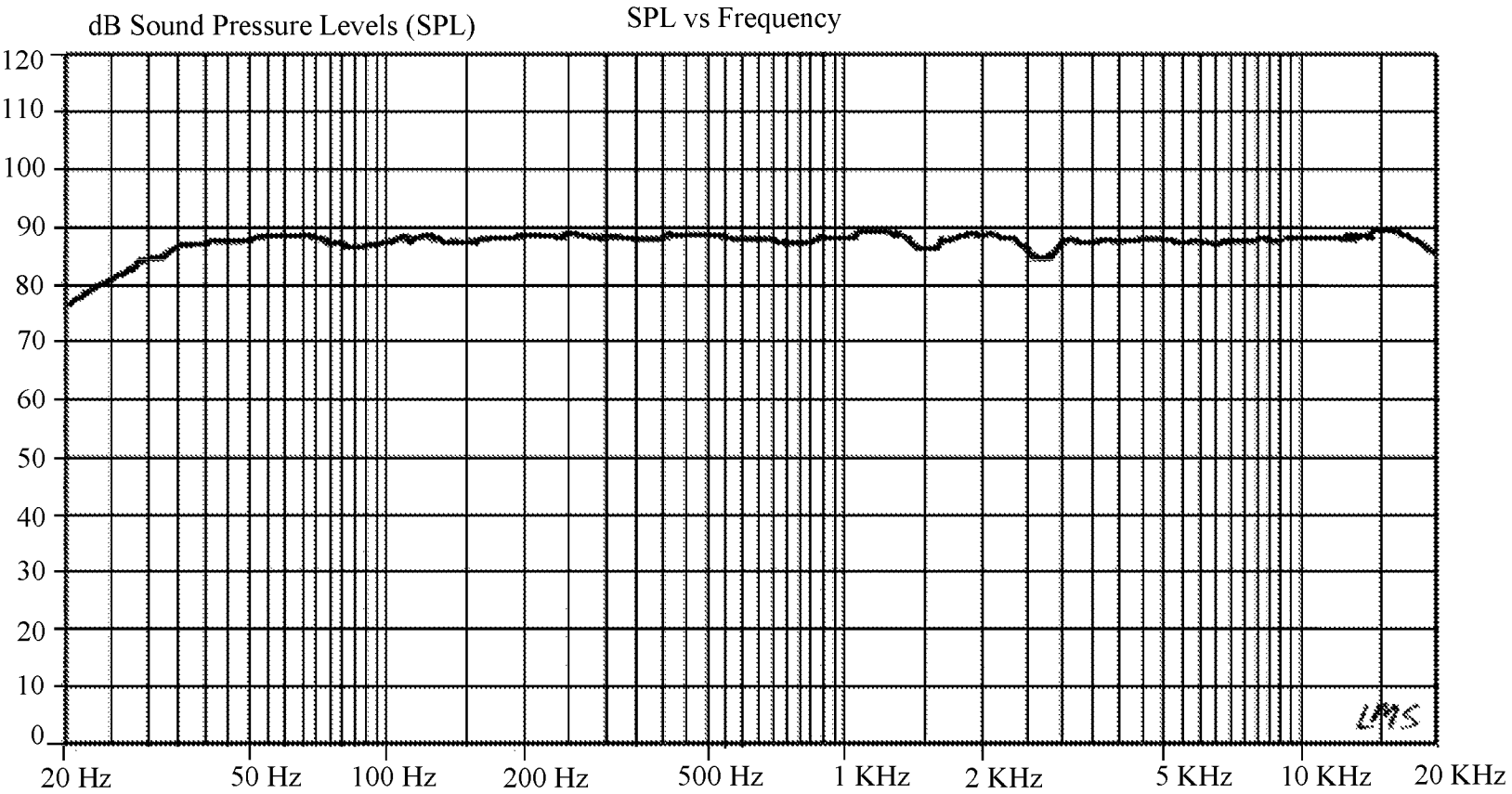
FIG. 3 exemplarily illustrates a frequency response curve of the embodiment of the speaker system shown in FIG. 2.

FIG. 3 exemplarily illustrates a frequency response curve of the embodiment of the speaker system 200 shown in FIG. 2. Sound pressure levels (SPL) is plotted against frequency to obtain the frequency response curve exemplarily illustrated in FIG. 3. The sound pressure level ranges from 0 dB to 120 dB and the frequency ranges from 20 hertz (Hz) to 20 KHz. The speaker system 200 exemplarily illustrated in FIG. 2, uses the tweeter driver 213 for reproducing audio signals in the high frequency range and the woofer driver 209 for reproducing audio signals in the mid-frequency to low frequency range with the crossover frequency at 2.3 KHz as disclosed in the detailed description of FIG. 2. The frequency response curve of the speaker system 200, that is, a 2-way speaker driver system is flatter and smoother as compared to a frequency response curve of a conventional speaker system, for example, the Pluto speaker system of Linkwitz Lab. As exemplarily illustrated in FIG. 3, the frequency response curve of the speaker system 200 ranges from 30 Hz to well beyond 20 KHz within ±3 dB range, with a smoother response in the middle frequency region, as compared to the frequency response curve of the conventional that ranges from 60 Hz to 15 KHz.

The speaker system 200 disclosed herein provides an improvement in speaker related technology as follows: The caliber of the woofer driver 209 increases from 5.25 inch to 6.5 inch contributing the frequency response to the lower frequency. The adapted design of the Venturi tube-shaped woofer chamber 205 extends the lower frequency response further lower to about 30 Hz, which is typically obtained with calibers of 8 inches or larger woofer drivers. The selection of a more suitable tweeter driver 213 contributes to a better response in the higher frequency range. Using an alloy metal material in the speaker system design instead of plastic tube materials significantly improves the smoothness of the response over a wide frequency range as exemplarily illustrated in FIG. 3. The actual listening experience illustrates a very smooth and balanced sound distribution among high, medium and low frequency ranges with a sense of intimacy of a staged sound field.

Figure 4:
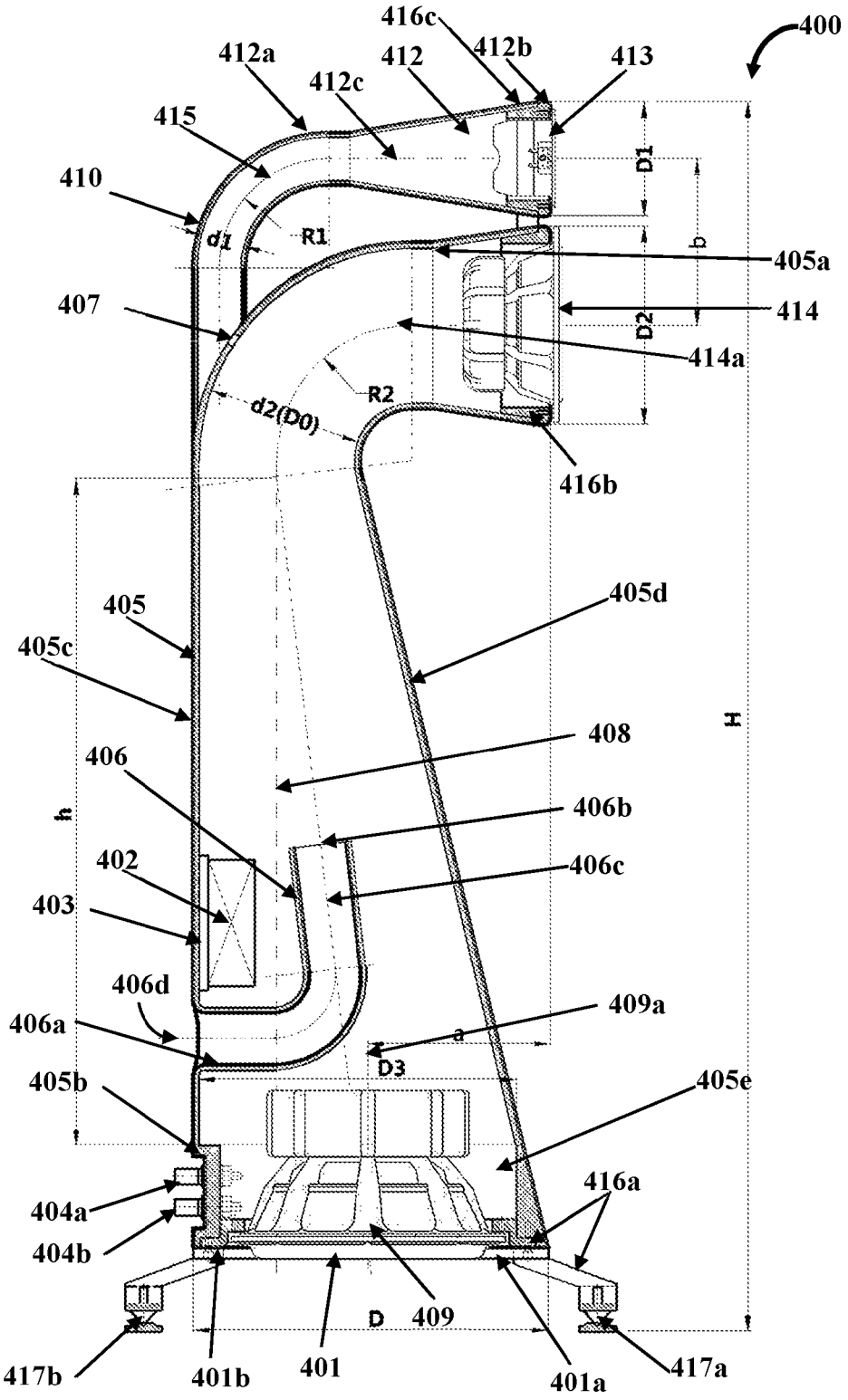
FIG. 4 exemplarily illustrates a sectional view of another embodiment of the speaker system.

FIG. 4 exemplarily illustrates a sectional view of another embodiment of the speaker system 200 exemplarily illustrated in FIG. 2. The speaker system 400 disclosed herein reproduces audio signals of a full audio frequency range. As exemplarily illustrated in FIG. 4, the speaker system 400 comprises a base member 401, a partial S-shaped woofer chamber 405, and a tweeter unit 410. The speaker system 400 further comprises three speaker drivers, that is, a subwoofer driver 409, a mid-woofer driver 414, and a tweeter driver 413. The speaker system 400 disclosed herein further comprises flange and bracket arrangements 416*a*, 416*b*, and 416*c* for fixing the subwoofer driver 409, the mid-woofer driver 414, and the tweeter driver 413, respectively, within the speaker system 400. At a lower end 401*a* of the base member 401, at least one base flange and bracket arrangement 416*a* is positioned to protect the speaker system 400 from movement. As exemplarily illustrated in FIG. 4, the speaker system 400 comprises legs 417*a* and 417*b*, for example, four legs, attached to the base flange and bracket arrangements 416*a* that are positioned at the lower end 401*a* of the base member 401 to hold the speaker system 400 steady while reproducing audio signals. The height of each of the legs 417*a* and 417*b* is h1 which is in the range of, for example, about 60 millimeters (mm) to about 100 mm. For example, in the speaker system 400 exemplary illustrated in FIG. 4, the height of each of the legs 417*a* and 417*b* is h1=80 mm.

The partial S-shaped woofer chamber 405 extends from an upper wall 401*b* of the base member 401. The partial S-shaped woofer chamber 405 comprises an upper end 405*a* and a lower end 405*b*. The upper end 405*a* and the lower end 405*b* of the partial S-shaped woofer chamber 405 are unsymmetrical as exemplarily illustrated in FIG. 4. The partial S-shaped woofer chamber 405 is defined by quasi-cylindrical tubular wall with opposing surfaces 405*c* and 405*d*. The partial S-shaped woofer chamber 405 expands from the upper end 405*a* towards the lower end 405*b* for producing a Venturi effect. An internal diameter of the upper end 405*a* of the partial S-shaped woofer chamber 405 is smaller than an internal diameter of the lower end 405*b* of the partial S-shaped woofer chamber 405. As exemplarily illustrated in FIG. 4, a frequency divider 402 is mounted at a predetermined position in the partial S-shaped woofer chamber 405. For example, the frequency divider 402 is mounted on a fixture, for example, a cover plate 403 connected to one of the opposing surfaces 405*c* and 405*d*, for example, the left opposing surface 405*c* of the partial S-shaped woofer chamber 405 as exemplarily illustrated in FIG. 4, at the backside, slightly above a vent 406*d* of a phase-reversing tube 406. In an embodiment, the frequency divider 402 exemplarily illustrated in FIG. 4, implements frequency division for the tweeter driver 413 and the mid-woofer driver 414 simultaneously and frequency division of the subwoofer driver 409 particularly. Input ends (not shown) of the frequency divider 402 are connected respectively, to two groups of input terminals, that is, to binding posts 404*a* and 404*b*, while output ends (not shown) of the frequency divider 402 are connected respectively to the tweeter driver 413, the mid-woofer driver 414, and the subwoofer driver 409. The partial S-shaped woofer chamber 405 comprises a lower cavity 405*e* for accommodating the subwoofer driver 409. The subwoofer driver 409 is positioned at the lower end 405*b* of the partial S-shaped woofer chamber 405 in a downward direction for reproducing extra low frequency audio signals. That is, the subwoofer driver 409 reproduces ultra-low frequency audio signals. The subwoofer driver 409 is positioned in the cavity 405*e* of the partial S-shaped woofer chamber 405, radiating downwards. The mid-woofer driver 414 is positioned at the upper end 405*a* of the partial S-shaped woofer chamber 405 in a frontward direction for reproducing medium frequency audio signals and low frequency audio signals. In the speaker system 400 exemplarily illustrated in FIG. 4, the mid-woofer driver 414 reproduces audio signals of frequencies, for example, between about 100 Hz to about 2.3 kHz. A horizontal central axis 414*a* of the mid-woofer driver 414 is perpendicular to a vertical central axis 409*a* of the subwoofer driver 409.

The speaker system 400 further comprises a phase-reversing tube 406 configured as a bass reflex unit extending into the partial S-shaped woofer chamber 405 for enhancing the low frequency audio signals reproduced by the subwoofer driver 409 and the medium frequency audio signals reproduced by the mid-woofer driver 414. The phase-reversing tube 406 comprises a circular cross-section symmetrical about an axis 406*c* of the phase-reversing tube 406. As exemplarily illustrated in FIG. 4, the phase-reversing tube 406 is defined by a 90° elbow pipe comprising a first end 406*a* rigidly connected to the lower end 405*b* of the partial S-shaped woofer chamber 405 with a vent 406*d* external to the partial S-shaped woofer chamber 405, and a free second end 406*b* extending into the partial S-shaped woofer chamber 405 parallel to a vertical central axis 408 of the partial S-shaped woofer chamber 405. The first end 406*a* of the phase-reversing tube 406 is positioned in a direction opposite to the tweeter driver 413. The frequency divider 402 is placed in the space between the phase-reversing tube 406 and the opposing surface 405*c*. With the phase-reversing tube 406 extending into the partial S-shaped woofer chamber 405, the partial S-shaped woofer chamber 405 is a ported type woofer chamber. In an embodiment, the partial S-shaped woofer chamber 405 is a closed type woofer chamber without the phase-reversing tube 406.

The tweeter unit 410 is rigidly connected proximal to the upper end 405*a* of the partial S-shaped woofer chamber 405 and extends outwardly from the upper end 405*a* of the partial S-shaped woofer chamber 405. The tweeter unit 410 is rigidly connected to one of the opposing surfaces 405*c* and 405*d*, for example, the left opposing surface 405*c* proximal to the upper end 405*a* of the partial S-shaped woofer chamber 405 via a connection hole 407 that is, for example, about 12 millimeter (mm) in diameter. The connection hole 407 accommodates the connecting wires that connect the tweeter driver 413 to the frequency divider 402. The tweeter unit 410 is constituted by an elbow pipe section 415 and a conical pipe section 412 extending from the elbow pipe section 415. The tweeter unit 410 is filled with an acoustic damping material. The tweeter driver 413 is positioned at a distal end 412*b* of the conical pipe section 412 of the tweeter unit 410. The tweeter driver 413 positioned at the distal end 412*b* of the tweeter unit 410 in the frontward direction reproduces high frequency audio signals. Ratio of a diameter of the distal end 412*b* and the proximal end 412*a* of the conical pipe section 412 is predetermined, for example, 2.0-2.5:1. Ratio of an axis bending radius R1 of the elbow pipe section 415 and an external diameter D1 of the conical pipe section 412 is predetermined, for example, 2.0-2.5:1. For example, the ratio of the diameter of the distal end 412*b* and the proximal end 412*a* of the conical pipe section 412 is 2.2:1, and ratio of the axis bending radius of the elbow pipe section 415 and the external diameter of the conical pipe section is 2.1:1. In FIG. 4, the lower end 401*a* of the base member 401 has a diameter D=338 mm, the partial S-shaped woofer chamber 405 has a diameter D0=150 mm and a radius R2=130 mm, the distal end 412*b* of the conical pipe section 412 of the tweeter unit 410 has a diameter D1=110 mm, the first end 405*a* of the partial S-shaped woofer chamber 405 has a diameter D2=190 mm, the upper end 401*b* of the base member 401 has a diameter D3=290 mm, the elbow pipe section 415 of the tweeter unit 410 has a bending radius R1=105 mm and an internal diameter d1=35 mm, the distance between the upper end 405*a* and the neck of the partial S-shaped woofer chamber 405 is h=800 mm, and the height of the speaker system 400 is H=1160 mm. The tweeter driver 413 in the conical pipe section 412 of the tweeter unit 410 is positioned above the mid-woofer driver 414 in the partial S-shaped woofer chamber 405. A horizontal central axis 412*c* of the tweeter driver 413 is parallel to the horizontal central axis 414*a* of the mid-woofer driver 414. A horizontal distance between a vertical central axis 405*b* of the subwoofer driver 409 and the tweeter driver 413, indicated by "a", is, for example, about 100 millimeters (mm) to about 250 millimeters. A vertical distance between a horizontal central axis 414*a* of the mid-woofer driver 414 and a horizontal central axis 412*c* of the tweeter driver 413, indicated by "b", is, for example, about 100 millimeters to about 200 millimeters. A caliber of the subwoofer driver 409 is, for example, between about 8 inches to about 13 inches. A caliber of the mid-woofer driver 414 is, for example, between about 5 inches to about 8 inches. A caliber of the tweeter driver 413 is, for example, between about 2 inches to about 4.5 inches.

In the speaker system 400, at least two pairs of binding posts extend from the base member 401. As exemplarily illustrated in FIG. 4, the pair of binding posts 404*a* and 404*b* extends from lower end 405*b* of the partial S-shaped woofer chamber 405 and internally connects the subwoofer driver 409, the mid-woofer driver 414, and the tweeter driver 413 to one or two external power amplifiers. The binding post 404*a* connects the mid-woofer driver 414 and the tweeter driver 413 after their parallel connection through the frequency divider 402 internally. The binding post 404*b* connects the subwoofer driver 409 through the frequency divider 402. Thus, two external power amplifiers are connected for each of the binding posts 404*a* and 404*b* as disclosed in the detailed description of FIG. 2. The speaker system 400 disclosed herein is compatible for connection to different external power amplifiers because a passive crossover is used. The passive crossover splits an amplified audio signal coming from an external power amplifier so that the amplified audio signal can be sent to two or more speaker drivers, for example, the subwoofer driver 409 and/or the mid-woofer driver 414 and the tweeter driver 413. In an embodiment, the binding posts 404*a* and 404*b* are connected in parallel using a pair of copper sheets externally and the pair of copper sheets are used to connect single external power amplifier for both the binding posts 404*a* and 404*b*. The frequency divider 402 is electrically connected to the subwoofer driver 409, the mid-woofer driver 414, and the tweeter driver 413 for splitting audio signals received from the external audio components and for feeding the split audio signals to the subwoofer driver 409, the mid-woofer driver 414, and the tweeter driver 413. In another embodiment, the input ends of two frequency dividers are connected to the binding posts 404*a* and 404*b* separately, and the output ends of the two frequency dividers are connected to the woofer driver 409, the woofer driver 414, and the tweeter driver 413. The base member 401, the partial S-shaped woofer chamber 405, and the tweeter unit 410 are molded or welded with metal alloys, for example, aluminum alloys, titanium alloys, etc., or timber.

The tweeter driver 413 and the mid-woofer driver 414 create a point sound source effect without a baffle. The tweeter driver 413 and the mid-woofer driver 414 form a main speaker with two divided frequency ranges, while the woofer driver 409 acts as the subwoofer. For example, if the system crossover point is set at 100 Hz, the main speaker formed by the tweeter driver 413 and the mid-woofer driver 414 assumes a main frequency band above 100 Hz, while the woofer driver 409 acts as the subwoofer having a subwoofer frequency band below 100 Hz. In an embodiment, if a bi-wiring connection is adopted, the main speaker is connected to the binding post 404*a* and the woofer driver 409 is connected to the binding post 404*b*. Two sets of power amplifiers (not shown) are used to drive the main speaker and the woofer driver 409 respectively, thus creating a set of reinforced 2.2 channel system. The 2.2 channel speaker system provides a high fidelity reproduction of the received audio signals and meets requirements of music enthusiasts and movie enthusiasts who enjoy listening to music while watching movies without extra sub-woofer and center-channel speaker set. The 2.2 channel speaker system provides music enthusiasts and movie enthusiasts with a viewing effect close to a cinema theater. The speaker system 400 exemplarily illustrated in FIG. 4, is a reinforced version of the speaker system 100 exemplarily illustrated in FIG. 1 and FIG. 2. The mid-woofer driver 414 turns into forward radiation, making the listening position to receive more direct sound so that the speaker system 400 provides a broader listening space; meanwhile, the image specificity is clearer. The subwoofer driver 409 is provided, such that, the low frequency gets deeper while the sound energy at the extra-low frequency range gets more abundant, significantly developing the acoustic surrounding to which the speaker adapts. The music enthusiasts and the movie enthusiasts can enjoy an optimal dynamic effect, when playing a symphony and/or a movie soundtrack in a room, for example, larger than about 50 $m^2$ to about 100 $m^2$.

The speaker systems 400 with the 2.2 channel configuration disclosed herein provides a further improvement with respect to the speaker systems 100 and 200 exemplarily illustrated in FIG. 1 and FIG. 2 respectively, to reproduce the audio signals for full range frequencies. This speaker system 400 comprises three speaker drivers 409, 414, and 413, and the frequency divider 402 with two crossover frequencies that divides the full audio frequency range into three sections. In an example, the low pass crossover frequency is set at about 100 Hz, while the high pass crossover frequency is set at about 2.3 kHz. In this embodiment, the tweeter driver 413 is responsible for reproducing audio frequencies ranging, for example, higher than about 2.3 kHz; the mid-woofer driver 414 is responsible for reproducing audio frequencies ranging, for example, between 100 Hz to 2300 Hz; and the subwoofer driver 409 is responsible for producing audio frequencies ranging, for example, lower than 100 Hz. The tweeter driver 413 and the mid-woofer driver 414 perform the main audio frequency reproduction, while the subwoofer driver 409 is the 0.1 channel as defined in a regular audio-visual (AV) system, responsible for lower than a 100 Hz extra low frequency range. Therefore, two such modified speaker systems constitute a 2.2 channel audio reproduction system. The speaker system 400 has two pairs of binding posts 404*a* and 404*b* that can be connected to two power amplifiers through bi-wiring. One amplifier is connected to the tweeter driver 413 and the mid-woofer driver 414 as the main loudspeaker while the other amplifier is connected to the subwoofer driver 409 to drive the ultra-low frequencies. Furthermore, instead of the mid-woofer driver 414 facing upwards, the mid-woofer driver 414 in the speaker system 400 faces frontwards, parallel in direction to the tweeter driver 413. Furthermore, the face down sub-woofer driver 414 is positioned at the bottom of the partial S-shaped woofer chamber 405 to substantially enhance the frequency below the 100 Hz range. The partial S-shaped woofer chamber 405 takes the advantages of the Venturi effect to eliminate the interferences of the possible standing waves in the partial S-shaped woofer chamber 405. This 2.2 channel speaker system is more suitable for audio reproduction in a large room, as well as for reproducing a more dynamic sound effect for a large orchestra and action movies.

The foregoing examples have been provided merely for the purpose of explanation and are in no way to be construed as limiting of the speaker systems 100, 200, and 400 disclosed herein. While the speaker systems 100, 200, and 400 have been described with reference to various embodiments, it is understood that the words, which have been used herein, are words of description and illustration, rather than words of limitation. Furthermore, although the speaker systems 100, 200, and 400 have been described herein with reference to particular means, materials, and embodiments, the speaker systems 100, 200, and 400 are not intended to be limited to the particulars disclosed herein; rather, the speaker systems 100, 200, and 400 extend to all functionally equivalent structures, methods and uses, such as are within the scope of the appended claims. Those skilled in the art, having the benefit of the teachings of this specification, may effect numerous modifications thereto and changes may be made without departing from the scope and spirit of the speaker systems 100, 200, and 400 disclosed herein in their aspects.

We claim:

1. A speaker system for reproducing audio signals of a plurality of frequency ranges, said speaker system comprising:

a base member;

a Venturi tube-shaped woofer chamber extending from an upper wall of said base member, said Venturi tube-shaped woofer chamber comprising an upper end, a middle section, and a lower end, wherein said Venturi tube-shaped woofer chamber tapers from said upper end towards said middle section and expands from said middle section towards said lower end for producing a Venturi effect, wherein internal diameters of said upper end and said lower end of said Venturi tube-shaped woofer chamber are greater than an internal diameter of said middle section of said Venturi tube-shaped woofer chamber;

a woofer driver positioned at said upper end of said Venturi tube-shaped woofer chamber in an upward direction for reproducing low frequency audio signals;

a tweeter unit rigidly connected proximal to said upper end of said Venturi tube-shaped woofer chamber and extending outwardly from said upper end of said Venturi tube-shaped woofer chamber; and a tweeter driver positioned at a distal end of said tweeter unit is a frontward direction for reproducing high frequency audio signals, wherein a horizontal central axis of said tweeter driver is perpendicular to a vertical central axis of said woofer driver, and wherein said woofer driver and said tweeter driver create a point sound source effect without a baffle.

2. The speaker system of claim 1, wherein said upper end and said lower end of said Venturi tube-shaped woofer chamber are one of symmetrical and unsymmetrical.

3. The speaker system of claim 1, wherein ratio of an internal diameter of said upper end of said Venturi tube-shaped woofer chamber to said internal diameter of said middle section of said Venturi tube-shaped woofer chamber is predetermined, and wherein ratio of an internal diameter of said lower end of said Venturi tube-shaped woofer chamber to said internal diameter of said middle section of said Venturi tube-shaped woofer chamber is predetermined.

4. The speaker system of claim 1, wherein said tweeter unit is constituted by a semi-circular pipe section and a conical pipe section extending from said semi-circular pipe section, and wherein said tweeter driver is positioned at said distal end of said conical pipe section.

5. The speaker system of claim 4, wherein said tweeter driver in said conical pipe section of said tweeter unit is positioned above said woofer driver of said Venturi tube-shaped woofer chamber.

6. The speaker system of claim 4, wherein ratio of a diameter of said distal end and a proximal end of said conical pipe section is predetermined, and wherein ratio of an axis bending radius of said semi-circular pipe section and an external diameter of said semi-circular pipe section is predetermined.

7. The speaker system of claim 1, further comprising a phase-reversing tube configured as a bass reflex unit extending into said Venturi tube-shaped woofer chamber for enhancing said low frequency audio signals reproduced by said woofer driver.

8. The speaker system of claim 7, wherein said phase-reversing tube is defined by a 90° elbow pipe comprising a first end rigidly connected proximal to said upper wall of said base member with a vent external to said Venturi tube-shaped woofer chamber and a free second end extending into said Venturi tube-shaped woofer chamber parallel to a vertical central axis of said Venturi tube-shaped woofer chamber, and wherein said first end of said phase-reversing tube is positioned in a direction opposite to said tweeter driver.

9. The speaker system of claim 7, wherein an upper section of said phase-reversing tube is configured in a conical shape comprising an upper end and a lower end for reducing airflow resistance and enhancing a low frequency response of said phase-reversing tube with high speed and high intensity, wherein an internal diameter of said upper end is greater than an internal diameter of said lower end.

10. The speaker system of claim 1, further comprising a space divider plate positioned proximal to a lower end of said base member for adjusting volume of space within said Venturi tube-shaped woofer chamber based on said woofer driver implemented in said Venturi tube-shaped woofer chamber.

11. The speaker system of claim 1, wherein said base member, said Venturi tube-shaped woofer chamber, and said tweeter unit are one of molded and welded with one of metal alloys and timber.

12. The speaker system of claim 1, wherein said Venturi tube-shaped woofer chamber is one of a ported type woofer chamber and a closed type woofer chamber.

13. The speaker system of claim 1, wherein a horizontal distance between said vertical central axis of said woofer driver and said tweeter driver is about 50 millimeters to about 160 millimeters, and wherein a vertical distance between said woofer driver and said horizontal central axis of said tweeter driver is about 70 millimeters to about 500 millimeters.

14. The speaker system of claim 1, wherein said internal diameters of said upper end and said lower end of said Venturi tube-shaped woofer chamber is about 1.3 times to about 2.3 times of said internal diameter of said middle section of said Venturi tube-shaped woofer chamber.

15. The speaker system of claim 1, wherein a caliber of said woofer driver is between about 5.5 inches to about 13 inches.

16. The speaker system of claim 1, wherein a caliber of said tweeter driver is between about 3 inches to about 4.5 inches.

17. A speaker system for reproducing audio signals of a full audio frequency range, said speaker system comprising:

a base member;

a partial S-shaped woofer chamber extending from an upper wall of said base member, said partial S-shaped woofer chamber comprising an upper end and a lower end, wherein said partial S-shaped woofer chamber expands from said upper end towards said lower end for producing a Venturi effect, wherein internal diameter of said upper end of said partial S-shaped woofer chamber is smaller than an internal diameter of said lower end of said partial S-shaped woofer chamber;

a subwoofer driver positioned at said lower end of said partial S-shaped woofer chamber in a downward direction for reproducing extra low frequency audio signals;

a mid-woofer driver positioned at said upper end of said partial S-shaped woofer chamber in a frontward direction for reproducing medium frequency audio signals and low frequency audio signals, wherein a horizontal central axis of said mid-woofer driver is perpendicular to a vertical central axis of said subwoofer driver;

a tweeter unit rigidly connected proximal to said upper end of said partial S-shaped woofer chamber and extending outwardly from said upper end of said partial S-shaped woofer chamber; and a tweeter driver positioned at a distal end of said tweeter unit in said frontward direction for reproducing high frequency audio signals, wherein a horizontal central axis of said tweeter driver is parallel to said horizontal central axis of said mid-woofer driver, and wherein said tweeter driver and said mid-woofer driver create a point sound source effect without a baffle.

18. The speaker system of claim 17, wherein said upper end and said lower end of said partial S-shaped woofer chamber are unsymmetrical.

19. The speaker system of claim 17, wherein said tweeter unit is constituted by an elbow pipe section and a conical pipe section extending from said elbow pipe section, and wherein said tweeter driver is positioned at said distal end of said conical pipe section.

20. The speaker system of claim 19, wherein said tweeter driver in said conical pipe section of said tweeter unit is positioned above said mid-woofer driver in said partial S-shaped woofer chamber.

21. The speaker system of claim 17, further comprising a frequency divider mounted at a predetermined position in said partial S-shaped woofer chamber, wherein said frequency divider is electrically connected to said subwoofer driver, said mid-woofer driver, and said tweeter driver for splitting audio signals received from an external audio component and feeding said split audio signals to said subwoofer driver, said mid-woofer driver, and said tweeter driver.

22. The speaker system of claim 17, wherein said partial S-shaped woofer chamber and said tweeter unit are one of molded and welded with one of metal alloys and timber within said speaker system.

23. The speaker system of claim 17, further comprising a phase-reversing tube configured as a bass reflex unit extending into said partial S-shaped woofer chamber for enhancing said low frequency audio signals reproduced by said subwoofer driver and by said mid-woofer driver.

24. The speaker system of claim 23, wherein said phase-reversing tube is defined by an elbow pipe comprising a first end rigidly connected proximal to said lower end of said partial S-shaped woofer chamber with a vent external to said partial S-shaped woofer chamber and a free second end extending into said partial S-shaped woofer chamber parallel to a vertical central axis of said partial S-shaped woofer chamber, and wherein said first end of said phase-reversing tube is positioned in a direction opposite to said tweeter driver.

25. The speaker system of claim 17, wherein said partial S-shaped woofer chamber is one of a ported type woofer chamber and a closed type woofer chamber.

26. The speaker system of claim 17, further comprising flange and bracket arrangements for fixing said subwoofer driver, said mid-woofer driver, and said tweeter driver within said speaker system.

27. The speaker system of claim 17, wherein a horizontal distance between said vertical central axis of said subwoofer driver and said tweeter driver is about 100 millimeters to about 250 millimeters, and wherein a vertical distance between said horizontal central axis of said mid-woofer driver and said horizontal central axis of said tweeter driver is about 100 millimeters to about 200 millimeters.

28. The speaker system of claim 17, wherein a caliber of said subwoofer driver is between about 8 inches to about 13 inches.

29. The speaker system of claim 17, wherein a caliber of said tweeter driver is between about 2 inches to about 4.5 inches.

30. The speaker system of claim 17, wherein a caliber of said mid-woofer driver is between about 5 inches to about 8 inches.

* * * * *